US009181906B2

(12) United States Patent
Takamatsu

(10) Patent No.: US 9,181,906 B2
(45) Date of Patent: Nov. 10, 2015

(54) FUEL VAPOR PROCESSING SYSTEMS

(75) Inventor: Hiroshi Takamatsu, Aichi-ken (JP)

(73) Assignees: AISAN KOGYO KABUSHIKI KAISHA, Obu-Shi, Aichi-Ken (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 779 days.

(21) Appl. No.: 13/323,849

(22) Filed: Dec. 13, 2011

(65) Prior Publication Data

US 2012/0145133 A1 Jun. 14, 2012

(30) Foreign Application Priority Data

Dec. 14, 2010 (JP) ..... 2010-277941

(51) Int. Cl.
*F02M 33/04* (2006.01)
*F02M 25/08* (2006.01)
*F02D 41/00* (2006.01)

(52) U.S. Cl.
CPC ..... *F02M 25/0836* (2013.01); *F02D 41/0032* (2013.01); *F02M 25/089* (2013.01); *F02D 41/0045* (2013.01); *F02D 2200/0602* (2013.01)

(58) Field of Classification Search
CPC ..... F02M 25/089; F02M 25/0818; F02M 25/0809; F02M 25/0836; F02M 25/0854; F02M 2025/0845; F02M 25/0872; F02M 2025/0881; F02M 25/08; F02M 25/0707; F02M 25/0709; F02M 25/0754; F02M 27/00; F02M 35/1038; F02D 41/0045; F02D 41/0032; F02D 2041/225; F02D 41/003; F02D 41/004; F02D 41/0042; G01M 3/04
USPC ..... 123/516–520
See application file for complete search history.

(56) References Cited

U.S. PATENT DOCUMENTS 6,161,423 A * 12/2000 Okuma ..... 73/40
6,182,642 B1 * 2/2001 Ohkuma ..... 123/520
6,722,348 B2 * 4/2004 Nagasaki et al. ..... 123/520
6,990,963 B2 1/2006 Hara et al.
7,373,929 B2 * 5/2008 Amano et al. ..... 123/491

(Continued)

FOREIGN PATENT DOCUMENTS

JP 09 203353 8/1997
JP 2000 110672 4/2000

(Continued)

OTHER PUBLICATIONS

Japanese Office Action mailed Jan. 21, 2014, corresponding to Japanese Patent Application No. 2010-277941; with English Translation attached.

*Primary Examiner* — Lindsay Low
*Assistant Examiner* — John Bailey
(74) *Attorney, Agent, or Firm* — Ladas & Parry LLP

(57) ABSTRACT

A fuel vapor processing system includes a canister, a tank passage communicating between the canister and the fuel tank, and a purge passage communicating between the canister and the intake air passage. Fuel vapor adsorbed by the canister can be desorbed and purged into the intake air passage via the purge passage due to a negative pressure produced in the intake air passage. A desorption promoting device can promote desorption of fuel vapor from the canister. A control unit controls the desorption device, so that the desorption promoting device promotes desorption of fuel vapor from the canister during desorption through the purge passage due to the negative pressure.

7 Claims, 7 Drawing Sheets

(56) References Cited

U.S. PATENT DOCUMENTS

| | | | | |
|---|---|---|---|---|
| 8,506,692 | B2 * | 8/2013 | Sugiura | 96/147 |
| 8,551,214 | B2 * | 10/2013 | Dudar et al. | 95/19 |
| 8,739,767 | B2 * | 6/2014 | Horiba et al. | 123/520 |
| 8,753,424 | B2 * | 6/2014 | Dudar et al. | 95/19 |
| 2003/0226549 | A1 * | 12/2003 | Takagi et al. | 123/520 |
| 2004/0200460 | A1 * | 10/2004 | Mitani et al. | 123/520 |
| 2004/0250796 | A1 * | 12/2004 | Veinotte | 123/520 |
| 2005/0044938 | A1 * | 3/2005 | Tsuruta et al. | 73/118.1 |
| 2005/0055144 | A1 * | 3/2005 | Steckler et al. | 701/31 |
| 2005/0211228 | A1 * | 9/2005 | Amano et al. | 123/520 |
| 2005/0234631 | A1 * | 10/2005 | Nomura | 701/102 |
| 2005/0257607 | A1 * | 11/2005 | Suzuki | 73/118.1 |
| 2005/0257608 | A1 * | 11/2005 | Suzuki | 73/118.1 |
| 2005/0257780 | A1 * | 11/2005 | Suzuki | 123/519 |
| 2006/0042605 | A1 * | 3/2006 | Amano et al. | 123/520 |
| 2006/0065253 | A1 * | 3/2006 | Reddy | 123/520 |
| 2006/0086343 | A1 * | 4/2006 | Suzuki | 123/520 |
| 2006/0185653 | A1 * | 8/2006 | Everingham et al. | 123/520 |
| 2006/0191330 | A1 * | 8/2006 | Hayakawa et al. | 73/118.1 |
| 2007/0119423 | A1 * | 5/2007 | Kano et al. | 123/459 |
| 2007/0119427 | A1 * | 5/2007 | Murakami | 123/520 |
| 2007/0157908 | A1 * | 7/2007 | Kano et al. | 123/520 |
| 2007/0181103 | A1 * | 8/2007 | Okuda | 123/520 |
| 2007/0186910 | A1 * | 8/2007 | Leone et al. | 123/520 |
| 2007/0186915 | A1 * | 8/2007 | Annoura | 123/698 |
| 2007/0214876 | A1 * | 9/2007 | Miyahara | 73/118.1 |
| 2007/0227515 | A1 * | 10/2007 | Uchida | 123/520 |
| 2007/0246024 | A1 * | 10/2007 | Sato | 123/520 |
| 2007/0246025 | A1 * | 10/2007 | Sato et al. | 123/520 |
| 2007/0251509 | A1 * | 11/2007 | Nakano et al. | 123/519 |
| 2007/0295313 | A1 * | 12/2007 | Amano et al. | 123/520 |
| 2008/0092858 | A1 * | 4/2008 | Satoh et al. | 123/520 |
| 2008/0271718 | A1 * | 11/2008 | Schondorf et al. | 123/520 |
| 2009/0084363 | A1 * | 4/2009 | Reddy | 123/520 |
| 2009/0133673 | A1 * | 5/2009 | Amano et al. | 123/520 |
| 2009/0250039 | A1 * | 10/2009 | Song | 123/520 |
| 2009/0277427 | A1 * | 11/2009 | Yoshimura | 123/520 |
| 2010/0275888 | A1 * | 11/2010 | Yuen et al. | 123/520 |
| 2011/0197862 | A1 * | 8/2011 | Der Manuelian et al. | 123/521 |
| 2011/0315127 | A1 * | 12/2011 | Jackson et al. | 123/521 |
| 2012/0132179 | A1 * | 5/2012 | Kobayashi et al. | 123/518 |
| 2012/0215399 | A1 * | 8/2012 | Jentz et al. | 701/32.8 |
| 2012/0222657 | A1 * | 9/2012 | Sano et al. | 123/520 |
| 2014/0102421 | A1 * | 4/2014 | Kato | 123/520 |
| 2014/0116402 | A1 * | 5/2014 | Horiba et al. | 123/520 |
| 2014/0150760 | A1 * | 6/2014 | Surnilla et al. | 123/568.21 |
| 2014/0158094 | A1 * | 6/2014 | Meiller | 123/518 |
| 2014/0174411 | A1 * | 6/2014 | Matsunaga et al. | 123/520 |

FOREIGN PATENT DOCUMENTS

| | | |
|---|---|---|
| JP | 2003 013812 | 1/2003 |
| JP | 2004 156499 | 6/2004 |
| JP | 2005-036759 A | 2/2005 |
| JP | 2009 074454 | 4/2009 |
| JP | 2010 096025 | 4/2010 |

* cited by examiner

FUEL VAPOR PROCESSING SYSTEMS

CROSS-REFERENCES TO RELATED APPLICATIONS

This application claims priority to Japanese Patent Application Serial Number 2010-277941, the contents of which are incorporated herein by reference.

BACKGROUND OF THE INVENTION

1. Field of the Invention

The present disclosure relates to fuel vapor processing systems, and in particular to fuel vapor processing systems for vehicles, such as automobiles, in which fuel vapor produced in a fuel tank is adsorbed by a canister and the adsorbed fuel is then purged into an intake air passage of an internal combustion engine.

2. Description of the Related Art

A vehicle equipped with an internal combustion engine (referred to as "engine", hereafter) is provided with a fuel vapor processing system for inhibiting fuel vapor produced in a fuel tank from flowing into the atmosphere. For example, Japanese Laid-Open Patent Publication No. 2004-156499 discloses a fuel vapor processing system having an adsorbent canister capable of adsorbing fuel vapor, a tank passage communicating between the canister and a fuel tank, a purge passage communicating between the adsorbent canister and an air intake passage of an engine, an atmospheric passage communicating between the adsorbent canister and the atmosphere, a purge control valve provided in the purge passage, and a control unit for controlling the purge control valve. Fuel vapor produced in the fuel tank is introduced into the canister through the tank passage so as to be adsorbed by the adsorbent of the canister. Then, air is introduced into the canister through the atmospheric passage by utilizing negative pressure generated in the engine in order to desorb the fuel vapor from the canister and to purge it into the air intake passage. Thus, it is able to restore the adsorbing function of the canister and to use the fuel vapor adsorbed within the canister for burning in the engine.

The fuel vapor processing system of the aforementioned Publication No. 2004-156499 includes an electromagnetic closing valve capable of opening and closing the tank passage and a pressure sensor for detecting the inner pressure of the fuel tank (hereinafter called a tank internal pressure). The electromagnetic valve is opened for reducing the tank internal pressure to be less than a predetermined pressure, so that the tank internal pressure can be released.

However, if the electromagnetic closing valve is opened to release the tank internal pressure when the tank internal pressure is high or when the concentration of fuel vapor within the fuel tank is high, it may be possible that a part of the fuel vapor is discharged from the canister to the atmosphere via the atmospheric passage. This problem may occur in particular in the case that a relatively large amount of fuel vapor is still remained within the canister without being desorbed.

Therefore, there has been a need in the art for a fuel vapor processing system that can improve desorption of fuel vapor from canister.

SUMMARY OF THE INVENTION

In one aspect of the present teachings, a fuel vapor processing system includes a canister, a tank passage communicating between the canister and the fuel tank, and a purge passage communicating between the canister and the intake air passage. Fuel vapor adsorbed by the canister can be desorbed and purged into the intake air passage via the purge passage due to a negative pressure produced in the intake air passage. A desorption promoting device can promote desorption of fuel vapor from the canister. A control unit controls the desorption device, so that the desorption promoting device promotes desorption of fuel vapor from the canister during desorption through the purge passage due to the negative pressure.

DETAILED DESCRIPTION OF THE INVENTION

Figure 1:
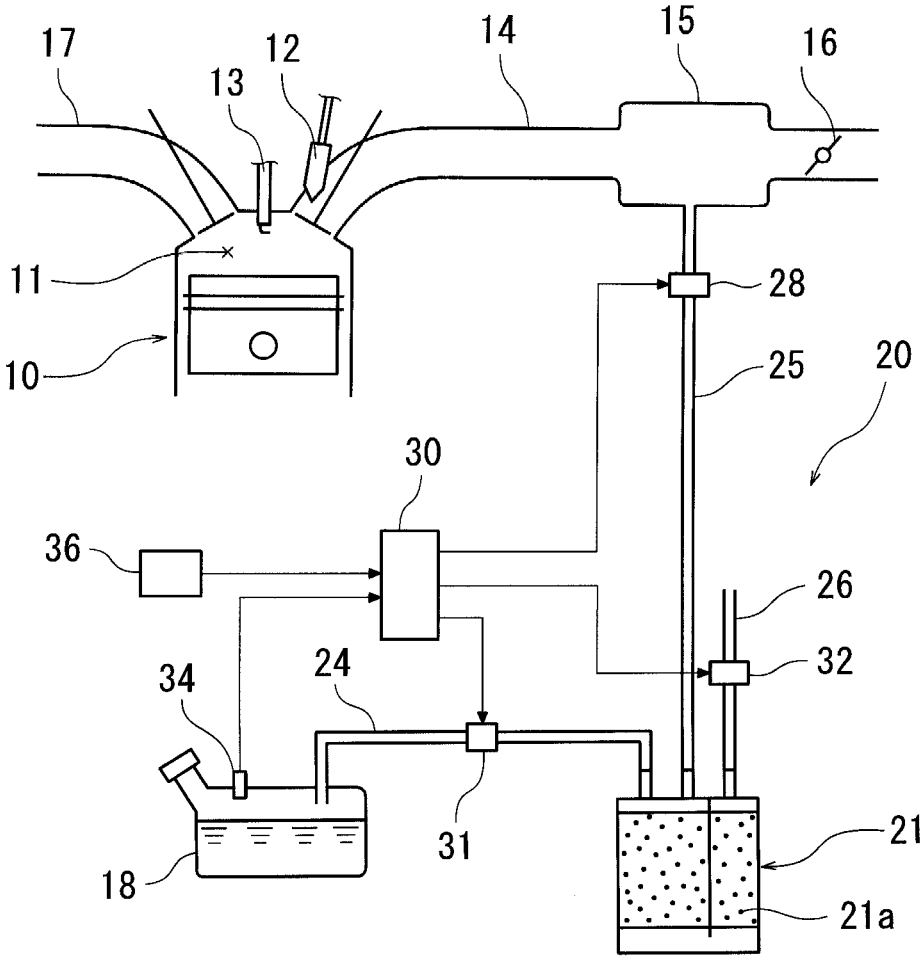
FIG. 1 is a structural diagram of a fuel vapor processing system according to a first example.

Each of the additional features and teachings disclosed above and below may be utilized separately or in conjunction with other features and teachings to provide improved fuel vapor processing systems. Representative examples of the present invention, which examples utilized many of these additional features and teachings both separately and in conjunction with one another, will now be described in detail with reference to the attached drawings. This detailed description is merely intended to teach a person of skilled in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one example, a fuel vapor processing system includes a canister capable of adsorbing fuel vapor, a tank passage communicating between the canister and a fuel tank, a purge passage communicating between an intake air passage of an internal combustion engine and the canister, an atmospheric passage communicating between the canister and the atmosphere, a purge control valve provided in the purge passage, and a control unit configured to control the purge control valve. Fuel vapor produced within the fuel tank is introduced into the canister via the tank passage, so that the canister adsorbs the fuel vapor. When the purge control valve is opened by the control unit during running of the internal combustion engine, air is drawn into the canister via the atmospheric passage due to an intake air negative pressure produced by the internal combustion engine, and fuel vapor is desorbed from the canister by the flow of the drawn air and is purged into the intake air passage via the purge passage. The fuel vapor processing system further includes an electromagnetic valve provided in the tank passage and capable of opening and closing the tank passage, and a desorption promoting device capable of promoting desorption of fuel vapor from the canister. The control unit is configured to further control the electromagnetic valve and the desorption promoting device such that, during opening of the purge control valve, the desorption promoting device operates to promote desorption of fuel vapor from the canister before the electromagnetic valve is opened.

With this arrangement, during the purge operation performed by opening the purge control valve, the desorption promoting device operates to promote desorption of fuel vapor from the canister before the electromagnetic valve is opened for releasing the tank internal pressure. Because promotion of desorption of fuel vapor from the canister is performed prior to releasing the tank internal pressure, it is possible to reduce the amount of fuel vapor that may remain within the canister. Hence, it is possible to inhibit the fuel vapor from being discharged from the canister into the atmosphere. This solution is particularly useful for reducing the amount of fuel vapor released from the canister into the atmosphere when the tank internal pressure is released in the case that the concentration of the fuel vapor in the fuel tank is relatively high.

The fuel vapor processing system may further include a tank internal pressure detector configured to detect a tank internal pressure within the fuel tank. In this connection, the control unit is configured such that the desorption promoting device is operated when the tank internal pressure is equal to or more than a predetermined value. With this arrangement, it is possible to promote desorption of fuel vapor immediately before the tank internal pressure is released.

The fuel vapor processing system may further include a purge concentration detector configured to detect concentration of fuel vapor contained in a purge gas that is purged from the canister into the intake air passage via the purge passage. In this connection, the control unit is configured such that the desorption promoting device is operated in the case that the fuel vapor concentration detected by the concentration detector is equal to or higher than a predetermined value and that the tank internal pressure detected by the tank internal pressure detector is equal to or higher than a predetermined value. With this arrangement, in the case that the concentration of fuel vapor detected by the concentration detector is equal to or higher than the predetermined value, it is possible to promote desorption of fuel vapor immediately before the tank internal pressure is released.

The control unit may be configured such that the electromagnetic valve is closed after the desorption promoting device is operated to promote desorption of fuel vapor from the canister. With this arrangement, it is possible to promote desorption of fuel vapor from the canister before the electromagnetic valve is closed, so that the amount of fuel vapor remaining within the canister can be reduced.

The desorption promoting device may be a decompression device capable of reducing the pressure within the canister. Therefore, it is possible to promote desorption of fuel vapor from the canister by reducing the pressure within the canister by the decompression device.

The decompression device may be an electromagnetic valve provided in the atmospheric passage and capable of switching flow rate of air flowing through the atmospheric passage from a first flow rate to a second flow rate smaller than the first flow rate. Thus, desorption of fuel vapor from the canister can be promoted by reducing the flow rate of air flowing through the atmospheric passage to cause reduction in pressure within the canister.

Alternatively, the desorption promoting device may be a heating device configured to heat inside of the canister. Thus, desorption of fuel vapor from the canister is promoted by heating inside of the canister by the heating device.

In another example, a fuel vapor processing system includes a canister capable of adsorbing fuel vapor, a tank passage communicating between the canister and a fuel tank, a purge passage communicating between an intake air passage of an internal combustion engine and the canister, an atmospheric passage communicating between the canister and the atmosphere, a purge control valve provided in the purge passage, and a control unit configured to control the purge control valve. Fuel vapor produced within the fuel tank is introduced into the canister via the tank passage, so that the canister adsorbs the fuel vapor. When the purge control valve is opened by the control unit during running of the internal combustion engine, air is drawn into the canister via the atmospheric passage by an intake air negative pressure produced by the internal combustion engine, so that fuel vapor is desorbed from the canister by the flow of the drawn air and is purged into the intake air passage via the purge passage. The fuel vapor processing system further includes a first electromagnetic valve provided in the tank passage and capable of opening and closing the tank passage, and a second electromagnetic valve provided in the atmospheric passage and capable of switching flow rate of air flowing through the atmospheric passage between a first flow rate and a second flow rate smaller than the first flow rate. The control unit is configured to further control the first and second electromagnetic valves such that the first electromagnetic valve is opened and closed when the second electromagnetic valve is switched to the side of the second flow rate during opening of the purge control valve.

With this arrangement, the tank internal pressure can be released by operating the first electromagnetic valve in the state that the second electromagnetic valve is switched to the side of the second flow rate (smaller flow rate) during the purge operation performed by opening the purge control valve. On the other hand, it is possible to inhibit fuel vapor from being discharged from the canister to the atmosphere by promoting desorption of fuel vapor from the canister in the state that the second electromagnetic valve is closed.

In this example, the control unit may be configured to control the first and second electromagnetic valves such that (a) the second electromagnetic valve is switched to the side of the first flow rate and the first electromagnetic valve is opened during refueling to the fuel tank and (b) the second electromagnetic valve is switched to the side of the second flow rate during non-refueling to the fuel tank. With this arrangement, the refueling operation can be smoothly performed due to switching of the second electromagnetic valve to the side of the first flow rate (larger flow rate) and opening the first electromagnetic valve during refueling. On the other hand, because the second electromagnetic valve is switched to the side of the second flow rate (smaller flow rate) during non-refueling, it is possible to inhibit fuel vapor from being discharged from the canister to the atmosphere irrespective of whether the first electromagnetic valve is opened or closed.

A first example will now be described with reference to FIGS. 1 to 9. FIG. 1 is a structural view of a fuel vapor processing system 20 according to the first example. The fuel vapor processing system 20 is used for a fuel supply system of a gas vehicle, such as an automobile, for supplying fuel to an engine (internal combustion engine) 10 having a fuel injection valve 12 and a spark plug 13. Fuel is supplied from a fuel tank 18 to the fuel injection valve 12 through a fuel supply pathway (not shown) and the fuel injection valve 12 injects the fuel into a combustion chamber 11. The spark plug 13 ignites mixed gas containing air and the fuel injected from the fuel injection valve 12. The combustion chamber 11 is connected with an air intake passage 14 that is a part of an air intake system and also with an exhaust passage 17 that is a part of an exhaust system. The air intake passage 14 is provided with a surge tank 15 and a throttle valve 16 positioned upstream of the surge tank 15. The throttle valve 16 serves to control an amount of air flowing through the air intake passage 14. The fuel vapor processing system 20 serves to inhibit fuel vapor produced (vaporized) within the fuel tank 18 from flowing into the atmosphere.

Next, a basic structure of the fuel vapor processing system 20 will be described. The fuel vapor processing system 20 has a canister 21 that can adsorb fuel vapor and allow desorption of fuel vapor. The canister 21 is disposed outside of the fuel tank 18. The canister 21 is filled with an adsorbent 21*a*. In this example, the adsorbent 21 is activated carbon granules capable of adsorbing fuel vapor and allowing desorption of the absorbed fuel vapor.

The fuel tank 18 and the canister 21 communicate with each other via a tank passage 24. The canister 21 and the surge tank 15 of the air intake passage 14 communicate with each other via a purge passage 25. The canister 21 also communicates with the atmosphere via an atmospheric passage 26. The purge passage 25 is provided with a purge control valve 28 capable of opening and closing the purge passage 25. The purge control valve 28 is controlled by, for example, a control unit 30 that will be described later. The purge control valve 28 is usually kept in an off state, where the purge passage 25 is closed or blocked by the purge control valve 28. When the purge control valve 28 is in an on state, the purge control valve 28 is opened to permit flow of fluid through the purge passage 25.

In this example, the control unit 30 is an engine control unit (ECU) having a central processing unit (CPU), a read-only memory (ROM), a random access memory (RAM), a backup RAM, an external input circuit and an external output circuit, etc. The control unit 30 is connected to various sensors for detecting various operating conditions of the engine 10. The control unit 30 can control various components, such as the purge control valve 28, a first electromagnetic valve (solenoid valve) 31 and a second electromagnetic valve (solenoid valve) 32, for processing fuel vapor based on signals transmitted from the sensors.

In the fuel vapor processing system 20, fuel vapor produced (vaporized) in the fuel tank 18 flows from the fuel tank 18 into the adsorbent canister 21 via the tank passage 24 and is then adsorbed by the adsorbent 21*a* filled in the canister 21. When the control unit 30 controls to open the purge control valve 28 during running of the engine 10, ambient air is introduced into the canister 21 through the atmospheric passage 26 due to action of a negative pressure produced within the intake air passage 14 of the engine 10 (hereinafter called "intake air negative pressure"). Therefore, fuel vapor absorbed by the canister 21 is desorbed from the canister 21 by the flow of ambient air and is then purged into the surge tank 15 of the air intake passage 14 through the purge passage 25. Then, the desorbed fuel vapor is introduced into the combustion chamber 11 together with the fuel injected from the fuel injection valve 12 into the combustion chamber 11 so as to be burned in the combustion chamber 11.

Next, primary components of the fuel vapor processing system 20 will be described in detail. As shown in FIG. 1, the first electromagnetic valve 31 capable of opening and closing the tank passage 24 is provided in the tank passage 24 for allowing and blocking communication through the tank passage 24. The first electromagnetic valve 31 opened and closed under the control of the control unit 30. The first electromagnetic valve 31 is normally kept in an off state to close or block the tank passage 24. When the first electromagnetic valve 31 is in an on state, the first electromagnetic valve 31 is opened to allow communication though the tank passage 24. Therefore, the first electromagnetic valve 31 serves as an electromagnetic opening and closing valve.

Figure 2:
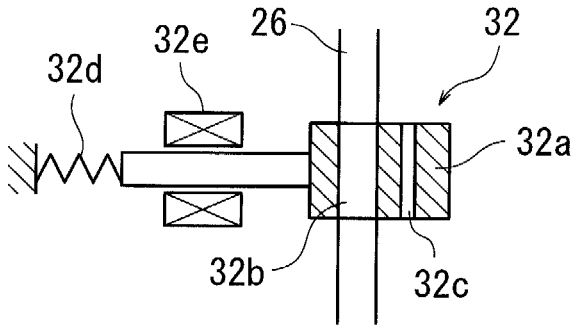
FIG. 2 is a schematic view showing an ON state of a second electromagnetic valve of the embodiment.
Figure 3:
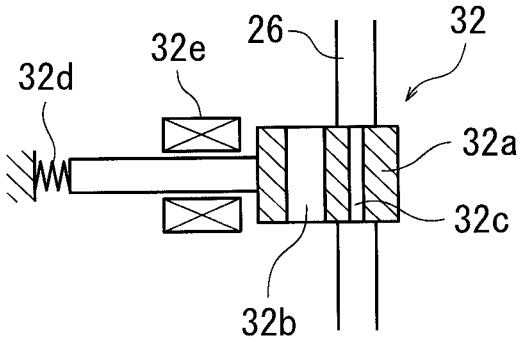
FIG. 3 is a schematic view showing an OFF state of the second electromagnetic valve.

The second electromagnetic valve 32 is provided in the atmospheric passage 26 and is capable of controlling a flow rate of air flowing though the atmospheric passage 26 between a first flow rate and a second flow rate smaller than the first flow rate. The second electromagnetic valve 32 operates under the control of the control unit 30. FIG. 2 is a schematic view showing the second electromagnetic valve 32 in the off state, whereas FIG. 3 is a schematic view showing the second electromagnetic valve 32 in the on state. The second electromagnetic valve 32 has a valve body 32*a*, a return spring 32*d* and a solenoid coil 32*e*. The valve body 32*a* has a first passage 32*b* and a second passage 32*c* extending therethrough for allowing flow of fluid. The cross sectional area of the first passage 32*b* is larger than that of the second passage 32*c*, so that a flow rate of fluid flowing through the first passage 32*b* is larger than that flowing through the second passage 32*c*. When the second electromagnetic valve 32 is in the off state, the first passage 32*b* communicates with the atmospheric passage 26 as shown in FIG. 2. On the other hand, when the second electromagnetic valve 32 is switched to the on state, the second passage 32*c* communicates with the atmospheric passage 26. In this way, the second electromagnetic valve 32 serves as an electromagnetic flow switching valve capable of switching the flow rate between the first flow rate (in the off state where the first passage 32*b* communicates with the atmospheric passage 26) and the second flow rate (in the on state where the second passage 32*c* communicates with the atmospheric passage 26). The second electromagnetic valve 32 may be replaced with any other flow switching valves as long as they can switch the flow rate of air flowing through the atmospheric passage 26 between two or more different flow rates.

As shown in FIG. 1, a pressure sensor 34 is mounted to the fuel tank 18 (in particular, an upper portion thereof) for detecting a tank internal pressure Pt that is a pressure within a gaseous region within the fuel tank 18. The pressure sensor 34 detects the tank inner pressure Pt as a pressure relative to the atmospheric pressure and outputs a signal corresponding to the detected pressure value. The output signal is inputted to the control unit 30. In this way, the pressure sensor 34 serves as a pressure detector for detecting the tank internal pressure Pt.

The control unit 30 also receives a signal from a purge concentration detector 36 that detects concentration of fuel vapor contained in a purge gas flowing from the canister 21 to the surge tank 15 of the air intake passage 14 through the purge passage 25. The purge concentration detector 36 may directly or indirectly detect concentration of fuel vapor contained in a purge gas. For example, the purge concentration detector 36 may be a fuel concentration sensor disposed in the purge passage 25 for directly detecting concentration of fuel vapor in a purge gas. Alternatively, the purge concentration detector 36 may be an oxygen sensor (not shown) disposed in the exhaust passage 17 and connected to the control unit 30, so that the control unit 30 calculates concentration of fuel vapor contained in a purge gas based on the concentration of oxygen detected by the oxygen sensor. If the fuel concentration value detected by the purge concentration detector 36 is equal to or higher than a predetermined value, the control unit 30 determines that the concentration is high. On the other hand, if the detected fuel concentration value is less than the predetermined value, the control unit 30 determines that the concentration is low.

Next, processes of controlling the purge control valve 28, the first electromagnetic valve 31 and the second electromagnetic valve 32 performed by the control unit 30 for processing the fuel vapor will be described.

Control During Parking of Vehicle

Figure 4:
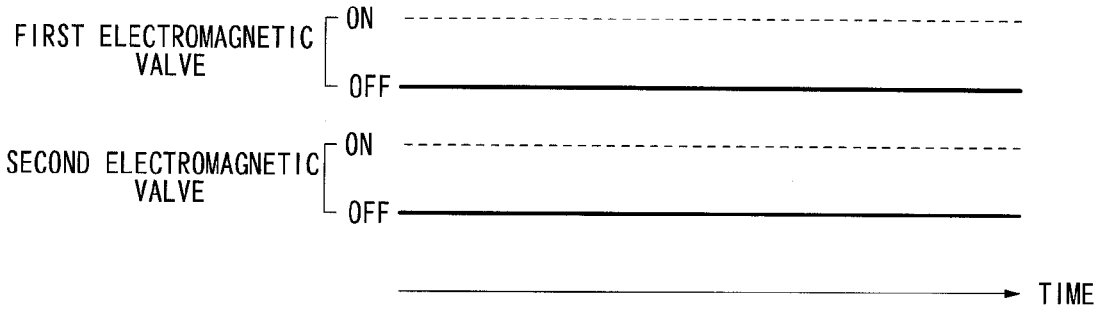
FIG. 4 is a timing chart showing the operations of a first electromagnetic valve and the second electromagnetic valve of the embodiment during parking.

When the engine 10 is stopped during parking of the vehicle, the first electromagnetic valve 31 is in the off state (i.e., the closed state), so that the tank passage 24 is closed or blocked. Also, the second electromagnetic valve 32 is in the off state, so that the atmospheric passage 26 communicates with the first passage 32*b* of the valve body 32*a*. In this state, the purge control valve 28 is in the off state (i.e., the closed state), so that the purge passage 25 is closed or blocked. FIG. 4 is a timing chart showing the operations of the first electromagnetic valve 31 and the second electromagnetic valve 32 during parking. Here, the term "during parking" used in this specification does not include a period for On-Board Diagnostics (OBD) by an On-Board Diagnostic System. During parking, since the first electromagnetic valve 31 is closed, the space within the fuel tank 18 is kept as a substantially closed space. If the tank internal pressure Pt detected by the pressure sensor 34 is out of a predetermined range, the first electromagnetic valve 31 is switched on (opened) in order to adjust the tank internal pressure Pt to have a value within the predetermined range. When the tank internal pressure Pt detected by the pressure sensor 34 has become within the predetermined range, the first electromagnetic valve 31 is switched off (closed).

Control During Refueling

Figure 5:
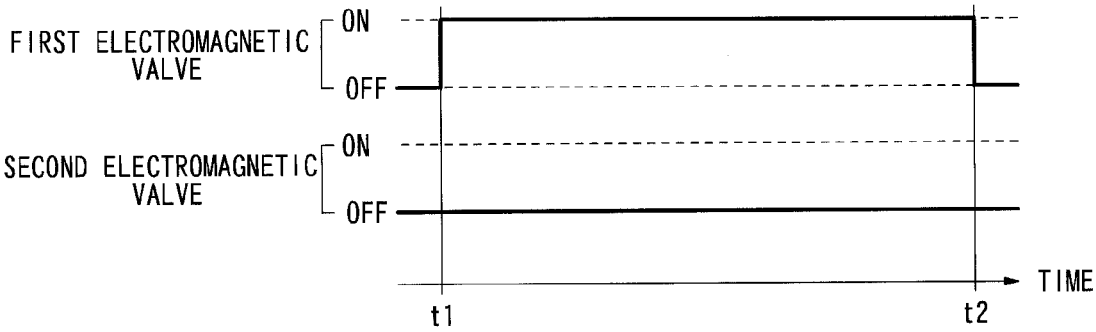
FIG. 5 is a timing chart showing the operations of the first and the second electromagnetic valves during refueling.

During refueling, both of the purge control valve 28 and the second electromagnetic valve 32 are in the off state, while the first electromagnetic valve 31 is in the on state (i.e., the open state), so that the tank passage 24 is opened. Therefore, during refueling, fuel vapor within the fuel tank 18 can flow into the canister 21 through the tank passage 24 and can be adsorbed by the adsorbent 21*a* filled in the canister 21. The remaining air after removal of the fuel vapor by the adsorbent 21*a* may flow from the canister 21 into the atmosphere through the atmospheric passage 26. After completion of refueling, the first electromagnetic valve 31 is switched off (closed). FIG. 5 is a timing chart showing operations of the first electromagnetic valve 31 and the second electromagnetic valve 32 during refueling. In FIG. 5, time point t1 is a point when refueling is started, whereas time point t2 is a point when refueling is finished. The control unit 30 can determine the time points t1 and t2 based on signals from a lid switch (not shown) that detects the state of opening and losing a fuel lid (not shown).

Control During Moving

During the movement of the vehicle (i.e., during running of the engine 10), the fuel vapor adsorbed by the canister 21 is purged. Thus, ambient air is introduced into the canister 21 through the atmospheric passage 26 by the action of the intake air negative pressure of the engine 10. Therefore, fuel vapor adsorbed by the adsorbent 21*a* of the canister 21 is desorbed and then flows into the surge tank 15 of the air intake passage 14 via the purge passage 25. After flowing into the surge tank 15, the fuel vapor is introduced into the combustion chamber 11 together with fuel injected by the fuel injection valve 12 so as to be burned in the combustion chamber 11. The purging operation is stopped or finished when the purge control valve 28 is switched off (closed).

Figure 6:
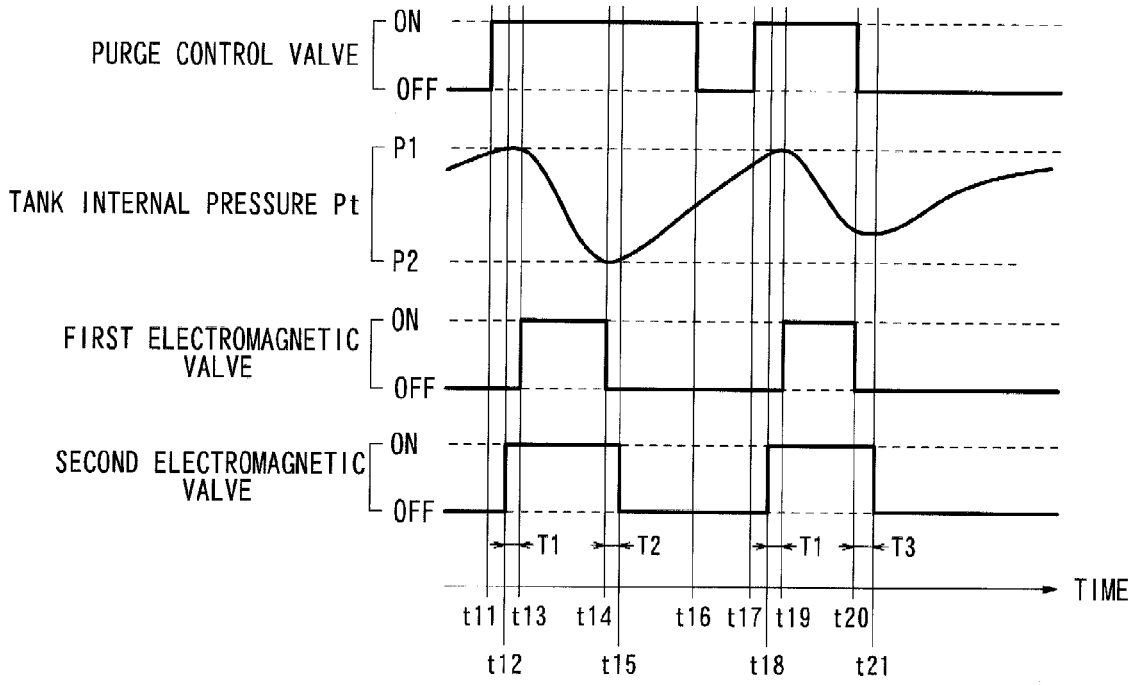
FIG. 6 is a timing chart showing operations of a purge control valve and the first and the second electromagnetic valves with change of an internal pressure of the fuel tank when a fuel concentration in a purge gas is high during movement of a vehicle.

Next, controls of the first electromagnetic valve 31 and the second electromagnetic valve 32 performed by the control unit 30 during the purge operation (i.e., in a condition that the purge control valve 28 is opened) will be described. First, the control performed by the control unit 30 in the case that the concentration of the fuel vapor in the purge gas is higher than the predetermined value during moving of the vehicle (during running of the engine 10) will be described. FIG. 6 is a timing chart showing operations of the purge control valve 28, the first electromagnetic valve 31 and the second electromagnetic valve 32 with change of the tank internal pressure Pt in the case that the concentration of the fuel vapor in the purge gas is higher than the predetermined value during the movement of the vehicle.

As shown in FIG. 6, the purge operation is not performed before time point t11 although the engine 10 is running. Before time point t11, the first electromagnetic valve 31 is in the off state (closed state), and the second electromagnetic valve 32 is also in the off state to allow air to flow at the first flow rate (larger flow rate) through the atmospheric passage 26. Because the first electromagnetic valve 31 is in the off state (closed state), the tank internal pressure Pt gradually increases as time.

Time point t11 is a point when the purge operation is started (i.e., when the purge control valve 28 is opened). Time point t12 is a point when the tank internal pressure Pt becomes equal to a predetermined value P1 as a result of increase during the purge operation. The predetermined value P1 is higher than a predetermined value P2 that will be explained later. Therefore, the predetermined value P1 and the predetermined value P2 will be hereinafter also called a high-pressure side predetermined value P1 and a low-pressure side predetermined value P2, respectively. At time point t12, the control unit 30 switches on the second electromagnetic valve 32 in order to decrease the amount of flow (i.e., the flow rate) flowing therethrough. As a result, the canister 21 is decompressed while being purged in the state that the first electromagnetic valve 31 is closed. This purge operation performed in the state that the canister 21 is decompressed will be hereinafter referred to as "decompression purge." The decompression purge facilitates vaporization or desorption of fuel vapor from the adsorbent 21*a* filled in the canister 21, and therefore, promotes desorption of fuel vapor from the canister 21. Accordingly, it is able to decrease an amount of the fuel vapor remaining in the canister 21 without being desorbed.

Time point t13 is a point after a predetermined time T1 from time point t12. At this point, the control unit 30 switches on the first electromagnetic valve 31, so that the first electromagnetic valve 31 is opened. This may cause decrease in the tank internal pressure Pt. In other words, the tank internal pressure Pt is released to gradually decrease. Time point t14 is a point when the tank internal pressure Pt becomes less than the predetermined value P2 (low-pressure side predetermined value P2) as a result of decrease. At this point, the control unit 30 switches off the first electromagnetic valve 31, so that the first solenoid vale 31 is closed. Therefore, the space within the fuel tank 18 is brought to be a substantially closed space, so that the tank internal pressure Pt gradually increases.

Time point t15 is a point after a predetermined time T2 from time point t14. At this point, the control unit 30 switches off the second electromagnetic valve 32, so that air can flow through the second electromagnetic valve 32 at the first flow rate (large flow rate). The state where the electromagnetic valve 32 is in the off state will be hereinafter also called a state switched to a large flow rate side. By the way, during the predetermined time T2 in the state that the first electromagnetic valve 31 is closed, inside of the canister 21, for which the purge operation is performed, is decompressed. In other words, the decompression purge is performed before (more specifically, immediately before) the first electromagnetic valve 31 is closed. Therefore, similar to the decompression purge performed before the first electromagnetic valve 31 is opened, desorption of fuel vapor from the canister 21 is facilitated, so that it is possible to promote desorption of fuel vapor. As a result, it is possible to reduce the amount of fuel vapor remaining within the canister 21 without being desorbed. When the second electromagnetic valve 32 is switched off, a normal purge operation is performed.

Time point t16 is a point when the purge operation is stopped or finished (i.e., when the purge control valve 28 is switched off) during the movement of the vehicle (during running of the engine 10). Therefore, the purge operation is performed during the period of time from time point t11 to time point t16. Time point t17 is similar to time point t11 and is a point when the purge operation is started or restarted (i.e., when the purge control valve 28 is switched on). Time point t18 is similar to time point t12 and is a point when the tank internal pressure Pt becomes equal to the high pressure side predetermined value P1 as a result of increase. At this point, the control unit 30 switches on the second electromagnetic valve 32, so that the second electromagnetic valve 32 is brought to the state switched to the side of the second flow rate (lower flow rate). Time point t19 is similar to time point t13 and is a point after the predetermined time T1 from time point t18. At this point, the control unit 30 switches on the first electromagnetic valve 31 to open it. Also, during the predetermined time T1, the decompression purge before opening of the first electromagnetic valve 31 is performed.

Time point t20 is a purge cut point when the purge operation is stopped or finished (i.e., when the purge control valve 28 is switched off) before the tank internal pressure Pt is reduced to be less than the low pressure side predetermined value P2. At this point, the control unit 30 switches off the first electromagnetic valve 31, so that the first electromagnetic valve 31 is closed. Time point t21 is a point after a predetermine time T3 from time point t20. At this point, the control unit 30 switches off the second electromagnetic valve 32, so that the second electromagnetic valve 32 is brought to be the state switched to the side of the first flow rate (higher flow rate). During the predetermined time T3, the decompression purge after closing the first electromagnetic valve 31 is performed. The predetermined time T2 and the predetermined time T3 may be the same period of time or may be different from each other. Similarly, the predetermined time T1 and the predetermined time T2 may be the same period of time or may be different from each other.

Figure 7:
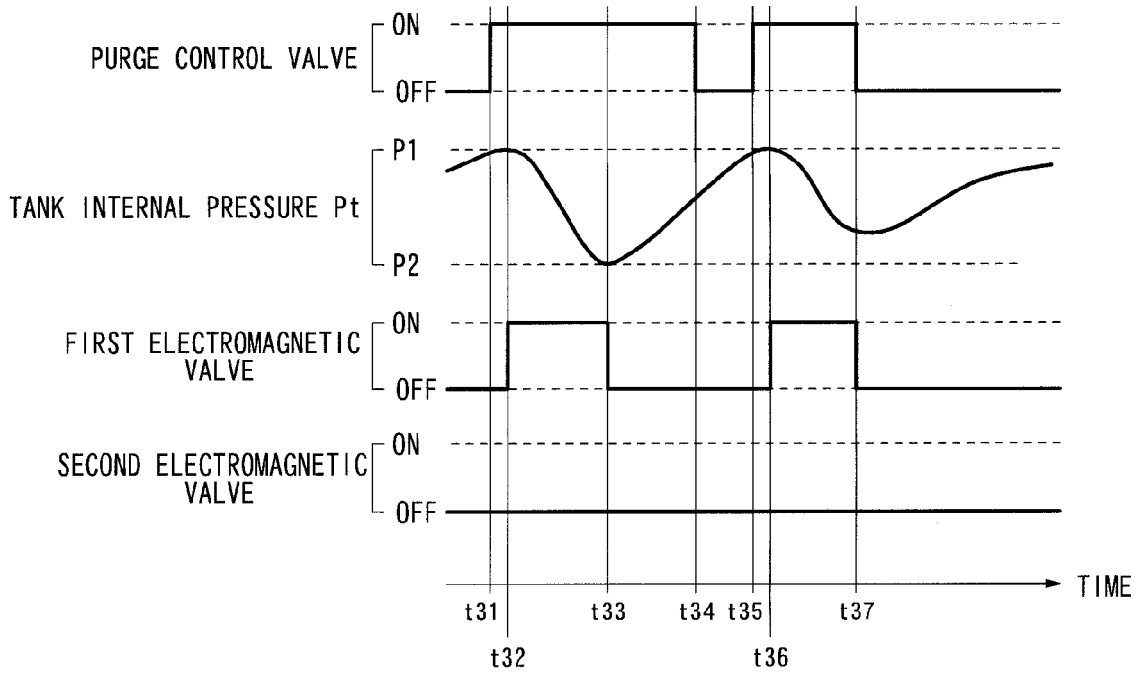
FIG. 7 is a timing chart showing operations of the purge control valve and the first and the second electromagnetic valves with change of the internal pressure of the fuel tank when the fuel concentration in the purge gas is low during movement of a vehicle.

Next, the description will be made to the case where the control unit 30 has determined the purge concentration to be lean or less than the predetermined value based on the detection signal from the purge concentration detector 36 during the movement of the vehicle (i.e., during running of the engine 10). FIG. 7 shows a timing chart showing the operations of the purge control valve 28, the first electromagnetic valve 31 and the second electromagnetic valve 32 with change of the tank internal pressure Pt in the case that the purge concentration is lean during the movement of the vehicle. In this case, the second electromagnetic valve 32 is always maintained to be the off state (i.e., the state switched to the side of the first flow rate (higher flow rate)).

As shown in FIG. 7, during running of the engine 10, the purge operation is not performed before time point t31. Before time point t31, the first electromagnetic valve 31 is kept off (closed). The tank internal pressure Pt may be increased after the first electromagnetic valve 31 is closed.

The purge control valve 28 is switched on (opened) to start the purge operation at time point t31. Time point t32 is a point when the tank internal pressure Pt becomes equal to the high-pressure side predetermined value P1 as a result of increase during the purge operation. At this point, the control unit 30 switches on (opens) the first electromagnetic valve 31. As a result, the tank internal pressure Pt is released, so that the tank internal pressure Pt gradually decreases.

Time point t33 is a point when the tank internal pressure Pt becomes less than the low pressure side predetermined value P2 as a result of decrease. At this point, the control unit 30 switches off (closes) the first electromagnetic valve 31. Therefore, the space within the fuel tank 18 is brought to be a substantially closed space, so that the tank internal pressure Pt gradually increases. Time point t34 is a point when the purge control valve 28 is switched off to finish the purge operation during the movement of the vehicle (i.e., during running of the engine 10). Therefore, the purge operation is performed during the period of time between time point t31 and time point t34.

Time point t35 is similar to time point t31 and is a point when the purge control valve 28 is switched on to start (restart) the purge operation. Time point t36 is similar to time point t32 and is a point when the tank internal pressure Pt becomes equal to the high pressure side predetermined value P1 as a result of increase. At this point, the control unit 30 switches on (opens) the first electromagnetic valve 31. Time point t37 is a point when the purge control valve 28 is switched off to finish the purge operation before the tank internal pressure Pt becomes less than the low pressure side predetermined value P2. At this point, the control unit 30 switches off (closes) the first electromagnetic valve 31.

Figure 8:
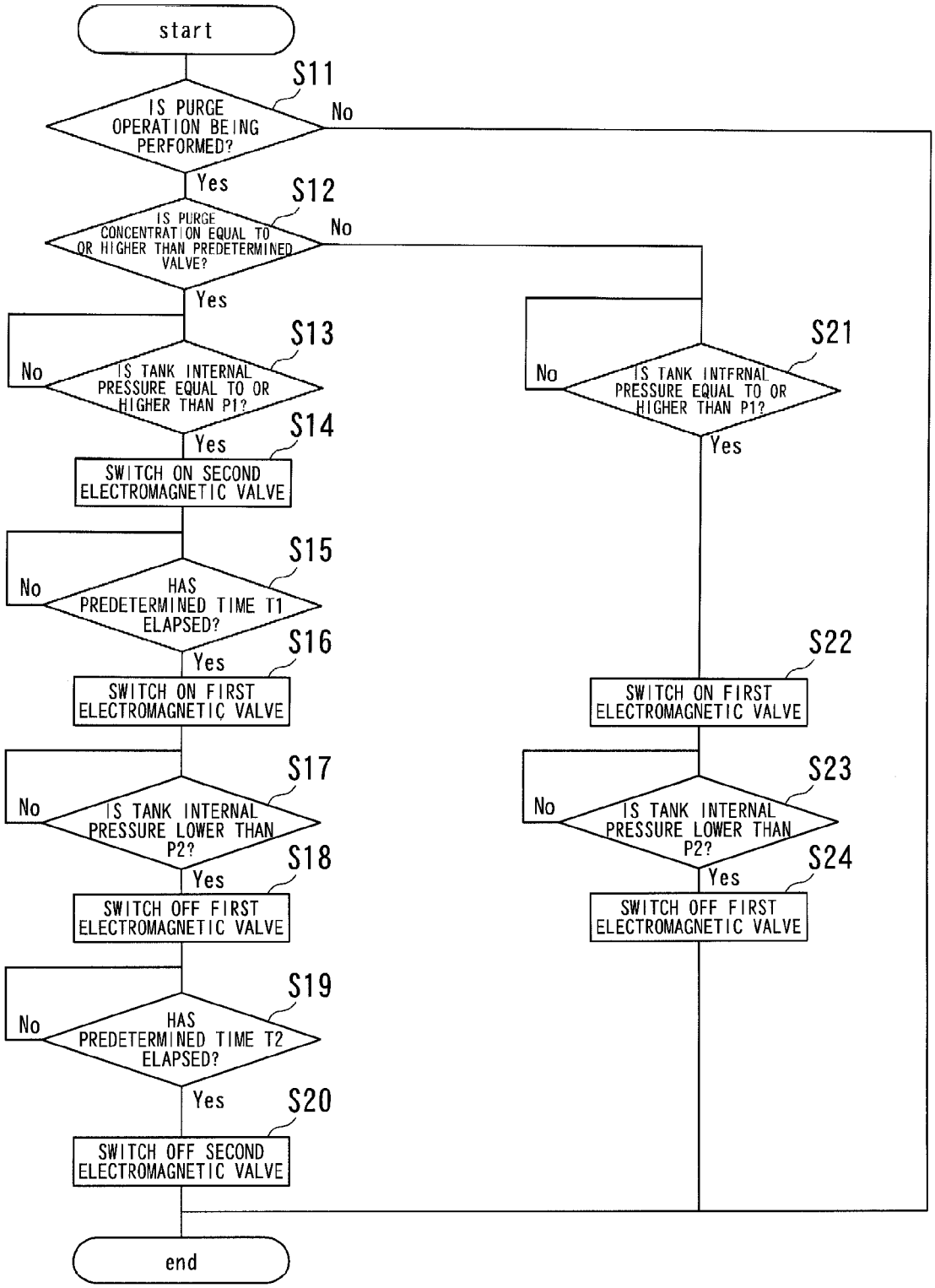
FIG. 8 is a flowchart showing a process routine executed for controlling the first and second electromagnetic valves during a purge operation.

Nest, a control routine performed by the control unit 30 will be described. FIG. 8 shows a flowchart of a process routine executed for controlling the first electromagnetic valve 31 and the second electromagnetic valve 32 during the purge operation. In the initial state, the first electromagnetic valve 31 and the second electromagnetic valve 32 are set to be the off state.

In the routine shown in FIG. 8, the control unit 30 first determines in step S11 as to whether the purge operation is being performed (i.e., whether the purge control valve 28 is in the on state (open state)). If the determination is NO (i.e., if the purge control valve 28 is in the off state (close state), the process is then finished.

If the determination in step S11 is YES (i.e. if the purge operation is being performed), the process proceeds to step S12, where determination is made as to whether the purge concentration is equal to or higher than a predetermined value. In the case that the determination is YES, the purge concentration is high, and therefore, if the first electromagnetic valve 31 is opened in this case, there is a possibility that fuel vapor cannot be entirely adsorbed by the canister 21, resulting in that some amount of fuel vapor is discharged to the atmosphere via the atmospheric passage 26. For this reason, step S13 and its subsequent steps are executed for inhibiting fuel vapor from being discharged to the atmosphere. It is to be noted that the tank internal pressure Pt increases as the process proceeds, because the first electromagnetic valve 31 is in the off state when starting the process routine.

The control unit 30 determines in step S13 as to whether the tank internal pressure Pt is equal to or more than the high-pressure side predetermined value P1. If the determination is NO, the process returns to step S12. If the determination is YES, the process proceeds to step S14, where the second electromagnetic valve 32 is switched on (the sate switched to the second flow rate (lower flow rate)). Therefore, the decompression purge before opening the first electromagnetic valve 31 is performed.

The control unit 30 has a timer that starts to operate at the same time the second electromagnetic valve 32 is switched on and is stopped when the predetermined time T1 has elapsed after that. The process proceeds from step S14 to step S15, determination is made as to whether the predetermined time T1 has elapsed. If the determination in step S15 is YES (i.e., if the predetermined time T1 has elapsed), the process proceeds to step S16, where the first electromagnetic valve 31 is switched on (opened). Therefore, the tank internal pressure Pt is released to gradually decrease.

Next, the process proceeds to step S17, where determination is made as to whether the tank internal pressure Pt is less than the low pressure side predetermined value P2. If the determination is NO (i.e., if the tank internal pressure Pt is not less than the predetermined value P2), the process returns to again make determination in step S17. If the determination is YES, the process proceeds to step S18, where the first electromagnetic valve 31 is switched off (closed). Therefore, the tank internal pressure Pt gradually increases while the decompression purge after closing the first electromagnetic valve 31 is performed.

At the same time the first electromagnetic valve 31 is switched off in step S18, the timer starts to operate. The timer is stopped when the predetermined time T2 has elapsed after it is started. The process proceeds from step S18 to S19, where determination is made as to whether the predetermined time T2 has elapsed. If the determination in step S19 is YES (i.e., if the predetermined time T2 has elapsed), the process proceeds to step S20, where the second electromagnetic valve 32 is switched off (the state switched to the side of the second flow rate (lower flow rate)). Then, the process is finished.

If the determination in step S12 is NO (i.e., if the purge concentration is less than the predetermined value), the process steps executed for the decompression purge in the case of high concentration are not performed. Instead, the process proceeds to step S21, where determination is made as to whether the tank internal pressure Pt is equal to or higher than the high pressure side predetermined value P1. If the determination is NO (i.e., if the tank internal pressure Pt is less than the predetermined value P1), the process returns to again make determination in step S21. If the determination is YES, the process proceeds to step S22, where the first electromagnetic valve 31 is switched on (opened). Therefore, the tank internal pressure Pt is released to gradually decrease.

The process proceeds from step S22 to step S23, where determination is made as to whether the tank internal pressure Pt is less than the low pressure side predetermined value P2. If the determination is NO (i.e., if the tank internal pressure Pt is equal to or higher than the predetermined value P2), the process returns to again make determination in step S23. If the determination is YES, the process proceeds to step S24, where the first electromagnetic valve 31 is switched off (closed). Then, the process is finished.

Figure 9:
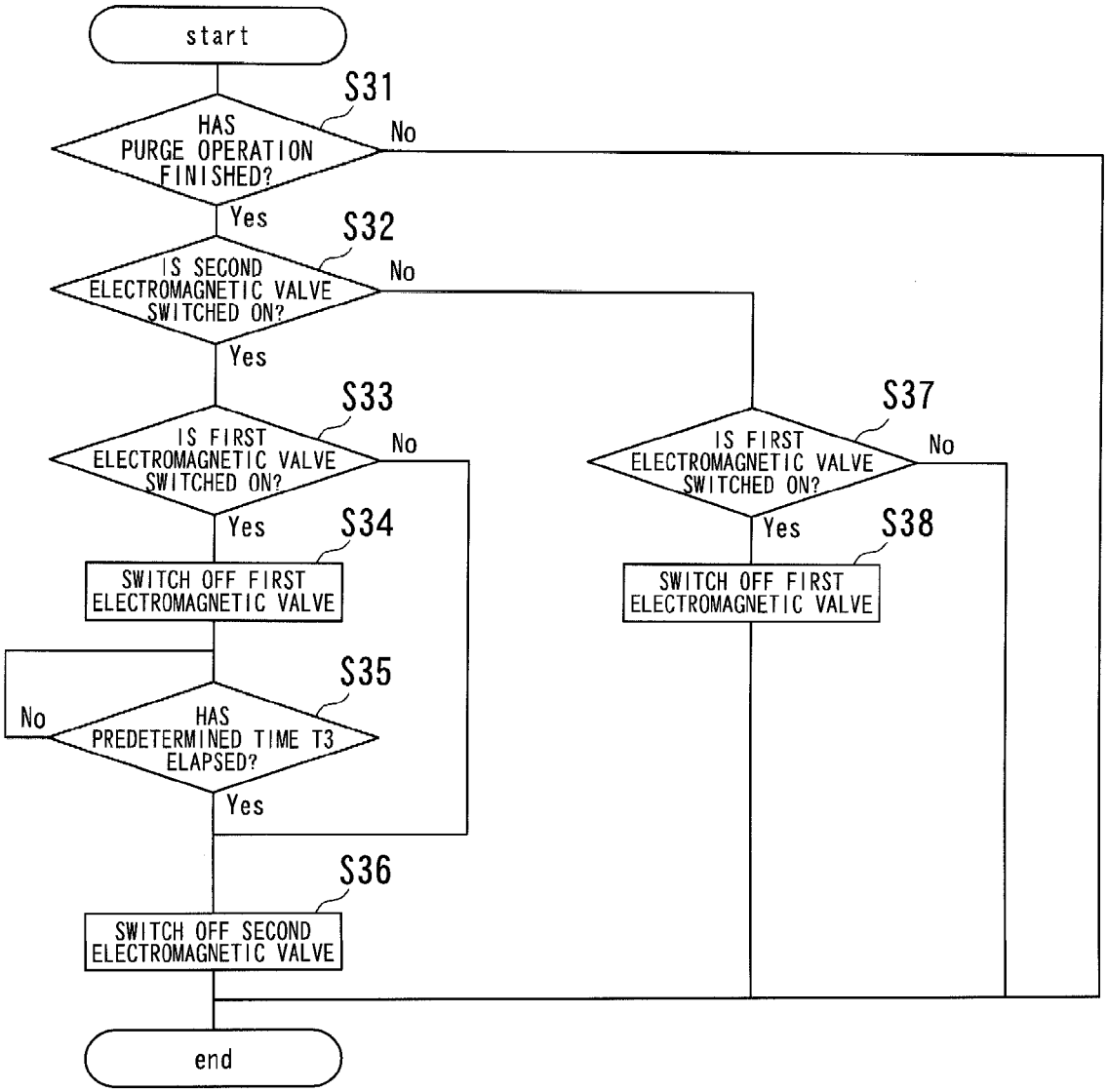
FIG. 9 is a flowchart showing a process routine executed for controlling the first and second electromagnetic valves when the purge operation has been finished.

If the purge operation is stopped or finished during the process routine of FIG. 8, a control routine shown in FIG. 9 is executed by the control unit 30. FIG. 9 is a flow chart of a process routine executed for controlling the first electromagnetic valve 31 and the second electromagnetic valve 32 in the case that the purge operation is stopped or finished.

In the process routine shown in FIG. 9, the control unit 30 first determines in step S31 as to whether the purge control valve 28 is in the off state (closed state) for stopping the purge operation. If the determination in step S31 is NO (i.e., if the purge operation is not stopped), the process is then finished.

If the determination in step S31 is YES, the process proceeds to step S32, where determination is made as to whether the second electromagnetic valve 32 is in the on state (the state switched to the side of the second flow rate (lower flow rate)). If the determination in step S32 is YES, the process proceeds to step S33, where determination is made as to whether the first electromagnetic valve 31 is in the on state (opened). If the determination in step S33 is YES, the process proceeds to step S34, where the first electromagnetic valve 31 is switched off (closed).

At the same time the first electromagnetic valve 31 is closed in step S34, the timer of the control unit 30 starts to operate. When the predetermined time T3 has elapsed from starting the timer in step S35, the second electromagnetic valve 32 is switched to the off state (i.e. the state switched to the side of the first flow rate (higher flow rate)) in step S36 and then the process is finished. On the other hand, if the determination in step S33 is NO (i.e., if the first electromagnetic valve 31 is in the off state), the process proceeds to step S36, where the second electromagnetic valve 32 is switched off.

On the other hand, if the determination in step S32 is NO (i.e., if the second electromagnetic valve 32 is in the off state (the state switched to the side of the first flow rate (higher flow rate)), the process proceeds to step S37, where determination is made as to whether the first electromagnetic valve 31 is in the on state (opened). If the determination in step S37 is NO, the process is then finished. If the determination in step S37 is YES, the process proceeds to step S38, where the first electromagnetic valve 31 is switched off (closed), and the process is then finished.

According to the fuel vapor processing system 20 of this example, during opening of the purge control valve 28 (i.e., during the purge operation), the second electromagnetic valve 32 is operated for promoting desorption of fuel vapor from the canister 21, and thereafter, the first electromagnetic valve 31 is opened to release the tank internal pressure Pt. Due to promotion of desorption of fuel vapor from with the canister 21 before (immediately before) the tank internal pressure Pt is released, it is possible to reduce the amount of fuel vapor remaining within the canister 21 without being desorbed. Hence, it is possible to inhibit the fuel vapor from being discharged from the canister 21 into the atmosphere. This solution is particularly useful for reducing the amount of fuel vapor discharged from the canister 21 into the atmosphere when the tank internal pressure Pt is released in the case that the concentration of the fuel vapor in the fuel tank 18 is high.

In addition, the fuel vapor processing system 20 is provided with the pressure sensor 34 for detecting the tank internal pressure Pt of the fuel tank 18, and the control unit 30 controls to operate the second electromagnetic valve 32 when the tank internal pressure Pt becomes equal to or more than the predetermined value. Therefore, it is possible to promote desorption of fuel vapor from the canister 21 immediately before the tank internal pressure Pt is released.

Further, the fuel vapor processing system 20 is provided with the purge concentration detector 36 for detecting concentration of fuel vapor contained in a purge gas flowing from the canister 21 to the air intake passage 14 through the purge passage 25. In the case that the concentration of fuel vapor detected by the concentration detector 36 is equal to or higher than the predetermined concentration value and that the tank internal pressure Pt detected by the pressure sensor 34 is equal to or higher than the predetermined pressure value, the control unit 30 operates the second electromagnetic valve 32. Therefore, in the case that the concentration of fuel vapor detected by the concentration detector 36 is equal to or higher than the predetermined value, it is possible to promote desorption of fuel vapor from the canister 21 immediately before the tank internal pressure Pt is released.

Furthermore, in the case that the first electromagnetic valve 31 is closed, the second electromagnetic valve 32 is operated to promote desorption of fuel vapor from the canister 21 before the first electromagnetic valve 31 is closed. Therefore, it is possible to reduce the amount of fuel vapor remaining within the canister 21 prior to closing the first electromagnetic valve 31.

Furthermore, the second electromagnetic valve 32 serves to reduce the pressure within the canister 21 for promoting desorption of fuel vapor from the canister 21. Therefore, the second electromagnetic valve 32 serves as a decompressing device and eventually as a desorption promoting device.

Furthermore, the second electromagnetic valve 32 is provided in the atmospheric passage 26 for reducing the flow rate of air flowing through the atmospheric passage 26. In this respect, the second electromagnetic valve 32 serves as a flow rate switching device for changing the flow rate of air flowing through the atmospheric passage 26.

Furthermore, the control unit 30 controls to open and close the first electromagnetic valve 31 when the purge control valve 28 is in the open state (i.e., during the purge operation) and the second control valve 32 is in the state switched to the side of the second flow rate (lower flow rate). Therefore, the tank internal pressure Pt is released when the second control valve 32 is in state switched to the side of the lower flow rate during the purge operation, while it is possible to reduce the amount of fuel vapor discharged from the canister 21 into the atmosphere by promoting desorption of fuel vapor from the canister 21 during opening of the first electromagnetic valve 31.

Further, the control unit 30 can switch the second electromagnetic valve 32 to the higher flow rate side and to open the first electromagnetic valve 31 during refueling, while the control unit 30 can switch the second electromagnetic valve 32 to the lower flow rate side when the refueling operation is not performed. Because the second electromagnetic valve 32 is switched to the higher flow rate side during refueling, the refueling operation can be smoothly performed. On the other hand, because the second electromagnetic valve 32 is switched to the lower flow rate side when the refueling operation is not performed, it is possible to inhibit the fuel vapor from being discharged from the canister 21 to the atmosphere irrespective of whether the first electromagnetic valve 31 is opened or closed.

Figure 10:
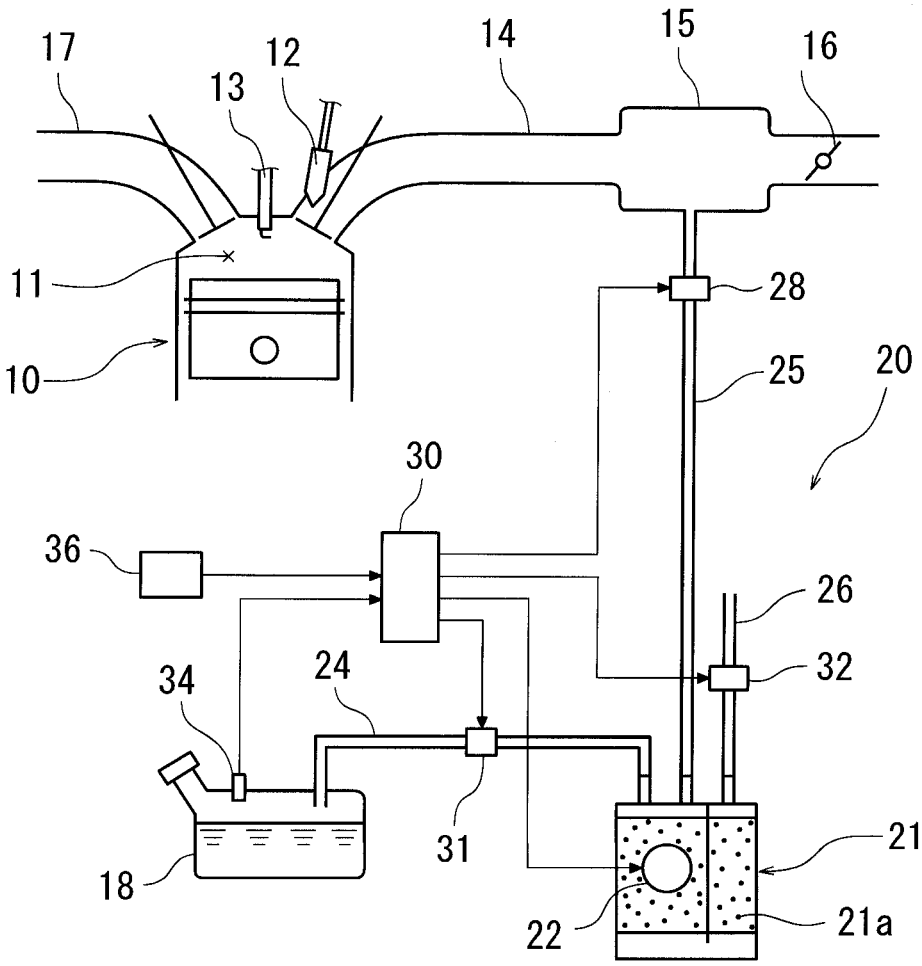
FIG. 10 is a structural diagram of a fuel vapor processing system according to a second example.

A second example will now be described with reference to FIG. 10. The second example is a modification of the first example. Therefore, the second example will be described for only the construction that is different from the first example. In FIG. 10, like members are labeled with the same reference numerals as the first example.

Referring to FIG. 10, a fuel vapor processing apparatus 20 of the second example includes an electric heater 22 disposed within the canister 21 for heating the adsorbent 21*a*. In order to desorb fuel vapor from the adsorbent 21*a*, it is preferable that the temperature of the adsorbent 21*a* is as higher as possible. However, as the fuel vapor is desorbed from the adsorbent 21*a*, the temperature of the adsorbent 21*a* is lowered due to the evaporation heat. Therefore, in this example, the electric heater 22 heats the adsorbent 21*a* during adsorption of the fuel vapor. Hence, it is possible to improve the desorption efficiency. The electric heater 22 is connected to the control unit 30, so that the electric heater 22 receives the supply of electric power under the control of the control unit 30. In this way, the electric heater 22 serves as a heating device for heating inside of the canister 12.

Thus, according to the second example, the electric heater 22 can be used as a desorption promoting device for promoting desorption of fuel vapor from the canister 12 by heating the adsorbent 21*a* within the canister 12. Therefore, in this example, it is possible to eliminate the second electromagnetic valve 32 (decompression device) in terms of its function as the desorption promoting device.

What is claimed is:

1. A fuel vapor processing system for processing fuel vapor produced in a fuel tank storing fuel that is supplied to an internal combustion engine having an intake air passage, comprising:

a canister capable of adsorbing fuel vapor;

a tank passage communicating between the canister and the fuel tank;

a purge passage communicating between the canister and the intake air passage of the internal combustion engine;

an atmospheric passage communicating between the canister and the atmosphere;

a purge control valve provided in the purge passage;

a control unit configured to control the purge control valve;

wherein fuel vapor produced within the fuel tank is introduced into the canister via the tank passage, so that the fuel vapor is adsorbed by the canister;

wherein when the purge control valve is opened by the control unit during running of the internal combustion engine, air is drawn into the canister via the atmospheric passage due to a negative pressure produced within the intake air passage of the internal combustion engine, so that fuel vapor is desorbed from the canister by the flow of the drawn air and is purged into the intake air passage via the purge passage;

a first electromagnetic valve provided in the tank passage and capable of opening and closing the tank passage; and a desorption promoting device capable of promoting desorption of fuel vapor from the canister, the desorption promoting device comprising a second electromagnetic valve provided in the atmospheric passage and capable of switching flow rate of air flowing through the atmospheric passage between a first flow rate and a second flow rate smaller than the first flow rate;

wherein the control unit is configured to further control the first electromagnetic valve and the second electromagnetic valve such that, during opening of the purge control valve, the second electromagnetic valve operates to switch the flow rate of air flowing through the atmospheric passage from the first flow rate to the second flow rate before the electromagnetic valve is opened, so that a pressure within the canister is reduced by the negative pressure produced within the intake air passage of the internal combustion engine to promote desorption of fuel vapor from the canister;

wherein the second electromagnetic valve includes a first passage and a second passage;

wherein a cross sectional area of the second passage is smaller than a cross sectional area of the first passage;

wherein the second electromagnetic valve is configured to be able to switch between a first state and a second state;

wherein, in the first state, the first passage communicates with the atmospheric passage, so that the air flows at the first flow rate;

wherein, in the second state, the second passage communicates with the atmospheric passage, so that the airflows at the second flow rate;

wherein, in the atmospheric passage, only the second electromagnetic valve is provided as a control device that controls the flow rate of the air flowing through the atmospheric passage; and wherein the control unit is configured to further control the first and second electromagnetic valves, such that:

the second electromagnetic valve is switched to the first state and the first electromagnetic valve is opened during refueling to the fuel tank; and the second electromagnetic valve is switched to the second state and the first electromagnetic valve is closed during non-refueling to the fuel tank.

2. The fuel vapor processing system as in claim 1, further comprising a tank internal pressure detector configured to detect a tank internal pressure within the fuel tank, wherein the control unit is configured such that the desorption promoting device is operated when the tank internal pressure is equal to or higher than a predetermined value.

3. The fuel vapor processing system as in claim 2, further comprising a purge concentration detector configured to detect concentration of fuel vapor contained in a purge gas that is purged from the canister into the intake air passage via the purge passage, wherein the control unit is further configured such that the desorption promoting device is operated in the case that the fuel vapor concentration detected by the concentration detector is equal to or higher than a predetermined value and that the tank internal pressure detected by the tank internal pressure detector is equal to or higher than a predetermined value.

4. The fuel vapor processing system as in claim 1, wherein the control unit is further configured such that the first electromagnetic valve is closed after the desorption promoting device is operated to promote desorption of fuel vapor from the canister.

5. The fuel vapor processing system as in claim 1, wherein the desorption promoting device further comprises a heating device configured to heat inside of the canister.

6. A fuel vapor processing system for processing fuel vapor produced in a fuel tank storing fuel that is supplied to an internal combustion engine having an intake air passage, comprising:

a canister capable of adsorbing fuel vapor;

a tank passage communicating between the canister and the fuel tank;

a purge passage communicating between the canister and the intake air passage of the internal combustion engine;

an atmospheric passage communicating between the canister and the atmosphere;

a purge control valve provided in the purge passage;

a control unit configured to control the purge control valve;

wherein fuel vapor produced within the fuel tank is introduced into the canister via the tank passage, so that the fuel vapor is adsorbed by the canister;

wherein when the purge control valve is opened under the control of the control unit during running of the internal combustion engine, air is drawn into the canister via the atmospheric passage due to a negative pressure produced in the air intake passage of the internal combustion engine, so that fuel vapor is desorbed from the canister by the flow of the drawn air and is purged into the intake air passage via the purge passage;

a first electromagnetic valve provided in the tank passage and configured to open and close the tank passage; and a second electromagnetic valve provided in the atmospheric passage and configured to switch flow rate of air flowing through the atmospheric passage between a first flow rate and a second flow rate smaller than the first flow rate; and wherein the control unit is configured to further control the first and second electromagnetic valves such that the first electromagnetic valve is operated during the time when a pressure within the canister is reduced by the negative pressure produced in the air intake passage of the internal combustion engine due to opening of the purge control valve and switching of the second electromagnetic valve is switched to the side of the second flow rate;

wherein the second electromagnetic valve includes a first passage and a second passage;

wherein a cross sectional area of the second passage is smaller than a cross sectional area of the first passage;

wherein the second electromagnetic valve is configured to be able to switch between a first state and a second state;

wherein, in the first state, the first passage communicates with the atmospheric passage, so that the air flows at the first flow rate;

wherein, in the second state, the second passage communicates with the atmospheric passage, so that the air flows at the second flow rate;

wherein, in the atmospheric passage, only the second electromagnetic valve is provided as a control device that controls the flow rate of the air flowing through the atmospheric passage; and wherein the control unit is configured to further control the first and second electromagnetic valves, such that:

the second electromagnetic valve is switched to the first state and the first electromagnetic valve is opened during refueling to the fuel tank; and the second electromagnetic valve is switched to the second state and the first electromagnetic valve is closed during non-refueling to the fuel tank.

7. The fuel vapor processing system as in claim 6, wherein the control unit is configured to further control the first and second electromagnetic valves such that:

the second electromagnetic valve is switched to the side of the first flow rate and the first electromagnetic valve is opened during refueling to the fuel tank; and the second electromagnetic valve is switched to the side of the second flow rate during non-refueling to the fuel tank.

* * * * *